US007069734B2

(12) United States Patent
Knopp

(10) Patent No.: US 7,069,734 B2
(45) Date of Patent: Jul. 4, 2006

(54) METHODS FOR DETECTING SURGE IN CENTRIFUGAL COMPRESSORS

(75) Inventor: John C. Knopp, Staunton, VA (US)

(73) Assignee: AAF-McQuay Inc., Minneapolis, MN (US)

( * ) Notice: Subject to any disclaimer, the term of this patent is extended or adjusted under 35 U.S.C. 154(b) by 88 days.

(21) Appl. No.: 10/827,109

(22) Filed: Apr. 19, 2004

(65) Prior Publication Data

US 2004/0221592 A1 Nov. 11, 2004

Related U.S. Application Data

(60) Provisional application No. 60/463,644, filed on Apr. 17, 2003.

(51) Int. Cl.

| | |
|---|---|
| ***G01K 13/00*** | (2006.01) |
| ***F25B 41/00*** | (2006.01) |
| ***F25B 1/00*** | (2006.01) |
| ***F25B 49/00*** | (2006.01) |

(52) U.S. Cl. ..... 62/129; 62/130; 62/201; 62/212; 62/226

(58) Field of Classification Search ..... 62/126, 62/129, 130, 185, 201, 212, 226
See application file for complete search history.

(56) References Cited

U.S. PATENT DOCUMENTS

| | | | | |
|---|---|---|---|---|
| 2,696,345 | A | | 12/1954 | Hopper |
| 3,555,844 | A | | 1/1971 | Fleckenstein et al. |
| 4,046,490 | A | | 9/1977 | Rutshtein et al. |
| 4,151,725 | A | | 5/1979 | Kountz et al. |
| 4,177,649 | A | * | 12/1979 | Venema ..... 62/209 |
| RE30,329 | E | | 7/1980 | Rutshtein et al. |
| 4,265,589 | A | | 5/1981 | Watson et al. |
| 4,282,718 | A | | 8/1981 | Kountz et al. |
| 4,363,596 | A | | 12/1982 | Watson et al. |
| 4,464,720 | A | | 8/1984 | Agarwal |
| 4,493,608 | A | | 1/1985 | Paul |
| 4,562,531 | A | * | 12/1985 | Enterline et al. ..... 700/44 |
| 4,581,900 | A | | 4/1986 | Lowe et al. |
| 4,686,834 | A | | 8/1987 | Haley et al. |
| 5,306,116 | A | | 4/1994 | Gunn et al. |
| 5,537,830 | A | * | 7/1996 | Goshaw et al. ..... 62/201 |
| 5,553,997 | A | | 9/1996 | Goshaw et al. |
| 5,726,891 | A | | 3/1998 | Sisson et al. |
| 5,746,062 | A | | 5/1998 | Beaverson et al. |
| 5,873,257 | A | | 2/1999 | Peterson |
| 5,894,736 | A | | 4/1999 | Beaverson et al. |
| 5,971,712 | A | | 10/1999 | Kann |
| 6,202,431 | B1 | | 3/2001 | Beaverson et al. |
| 6,213,724 | B1 | | 4/2001 | Haugen et al. |

(Continued)

*Primary Examiner*—Marc Norman
(74) *Attorney, Agent, or Firm*—Patterson, Thuente, Skaar & Christensen, P.A.

(57) ABSTRACT

A method and apparatus for detecting surge in a refrigeration system that includes a centrifugal compressor having an impeller and a compressor entrance, an evaporator that receives a fluid refrigerant, a suction line that flows the refrigerant from the evaporator to the compressor entrance. The evaporator includes a heat-exchange coil supplied with a liquid through a supply line entering the evaporator. The liquid is disposed in a heat-exchange relationship with the refrigerant within the evaporator. The method and apparatus automatically and periodically performing the steps of measuring a fluid temperature of the liquid proximate the supply line entering the evaporator; measuring a refrigerant temperature of the refrigerant proximate the compressor entrance; and using the fluid temperature and the refrigerant temperature to detect surge in the refrigeration system.

28 Claims, 3 Drawing Sheets

U.S. PATENT DOCUMENTS

| | | | |
|---|---|---|---|
| 6,427,464 | B1 | 8/2002 | Beaverson et al. |
| 6,513,333 | B1 | 2/2003 | Sugitani |
| 2002/0170304 | A1 | 11/2002 | Beaverson et al. |
| 2003/0161715 | A1 | 8/2003 | McKee et al. |
| 2004/0031286 | A1 | 2/2004 | Bodell et al. |

* cited by examiner

MT II Low Load Surge

EvEWT is Evaporator Entering Water Temperature 200

EvLWT is Evaporator Leaving Water Temperature

SctnT1 is the Suction Refrigerant Temperature 210

%RLA is the AMP in percent of the Rated Load Amps of the compressor

METHODS FOR DETECTING SURGE IN CENTRIFUGAL COMPRESSORS

CLAIM TO PRIORITY

The present application claims priority to U.S. Provisional Application No. 60/463,644, filed Apr. 17, 2003, and entitled "METHODS FOR DETECTING SURGE IN CENTRIFUGAL COMPRESSORS." The identified provisional patent application is hereby incorporated by reference.

FIELD OF THE INVENTION

The present invention generally relates to chiller systems. More specifically, the present invention relates to methods for detecting surge in a centrifugal compressor integral to a refrigeration system.

BACKGROUND OF THE INVENTION

Surging is an unstable operating condition that occurs in compressors, including centrifugal compressors used in refrigeration systems. Such a condition can be caused by an increase or decrease in compressor discharge pressure or by a reduction in the flow of gas to the compressor. These events can be triggered by poor maintenance of the refrigeration system, failure of a system component, or human error. Excessive surging, either in number of occurrences or in magnitude, may result in damage or complete failure of the compressor. Surging also results in inefficiencies in operation of a refrigeration system that result in excessive power consumption.

Extreme surging may be detectable by inspection of an operating compressor, by those knowledgeable in the art, but a compressor can operate in a surge condition with little vibration experienced. Different methods of detecting surge conditions in centrifugal compressors are known in the art. One method of detecting surge in a compressor is to monitor vibration of the compressor by mounting a vibration detector on or near the compressor to sense vibration caused by the compressor in a surged condition. Shortcomings of this method include the need for an extremely sensitive vibration sensor and false surge indications during start-up of the compressor.

Another method of detecting surge is by monitoring flow and pressure differences in the vicinity of the compressor as disclosed in U.S. Pat. No. 3,555,844, which is incorporated herein by reference. An alternative means of detecting surge is disclosed in U.S. Pat. No. 2,696,345, which is incorporated herein by reference and teaches monitoring temperature upstream of the impeller to detect an increase in temperature that precedes major surging. That same patent discloses a method of detecting surge by monitoring temperature on the discharge side of an axial flow compressor. However, as noted in U.S. Pat. No. 4,363,596, monitoring temperature in the discharge is not effective in a refrigerant compressor because the discharge temperature of such a compressor will actually go down when the compressor is in surge, since the flow to the discharge is basically stopped.

U.S. Pat. No. 4,363,596 teaches a method of detecting surge by measuring a temperature rise beyond a predetermined value in a space in the impeller chamber of the compressor, exterior of the flow path of gas through the impeller. The specification states that the temperature rise, above the normal operating temperature, occurring when the compressor is surging is caused by the increased heat produced by reduced compressor efficiency and the inability of the reduced gas flow to remove the heat. The disadvantage of this approach is that it measures the temperature rise in one location inside the impeller chamber and does not take into account that the temperature at the location may change due to a change in the operation condition of the compressor even when there is no surge. For example, a start-up condition is likely to give a false surge reading.

In the system disclosed in U.S. Pat. No. 4,151,725, a control system effectively maximizes efficiency without encountering surge problems by monitoring the temperature of the refrigerant in the condenser discharge line, the temperature of the saturated refrigerant leaving the evaporator, the temperature of the chilled water discharged from the evaporator of the chiller, and the inlet guide vane position. Based on the foregoing four parameters and a set point temperature input, the control system described in U.S. Pat. No. 4,151,725 effectively regulates the refrigeration system by regulating the speed of the compressor and adjusting vane position. A person skilled in the art will recognize that the temperatures being measured are unlikely to be influenced by incipient surge.

U.S. Pat. No. 5,746,062 discloses the method of detecting surges in a centrifugal compressor via sensing suction and discharge pressures of the compressor. The same patent also discloses surge detection through monitoring of the current applied to the variable speed motor drive that drives the compressor. It will be readily apparent to one skilled in the art that a sudden change in the load on the system, not necessarily related to surge, could also influence the current applied to the motor thus increasing the likelihood of a false positive detection of surge. This patent also teaches utilizing both pressure sensing and current sensing techniques to detect a surge. U.S. Pat. No. 5,746,062 is incorporated herein by reference.

The existing methods for detecting surges in centrifugal compressors integral to refrigeration systems are concentrated on monitoring conditions in the proximity of the compressor. One of the disadvantages of such systems is that they can generate a high number of false positive readings on account of their being influenced by localized, transient effects that generally may not be indicative of surge.

SUMMARY OF THE INVENTION

The present invention incorporates the use of operating conditions beyond the immediate vicinity of a centrifugal compressor of a refrigeration system to provide an accurate method of detecting surge in the compressor. One aspect of the present invention utilizes sensors to monitor the temperature differential between the suction temperature at the entrance to the compressor impeller and the evaporator water temperature. Another aspect of the invention compares the temperature differential between the suction temperature and evaporator water temperature to data points that correspond to the various operating conditions of the refrigeration system. By utilizing a more expansive set of operating conditions of the total refrigeration system in making a determination of whether a surge condition exists, the present invention reduces the influence of systemic transient conditions.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE PREFERRED EMBODIMENTS

Figure 1:
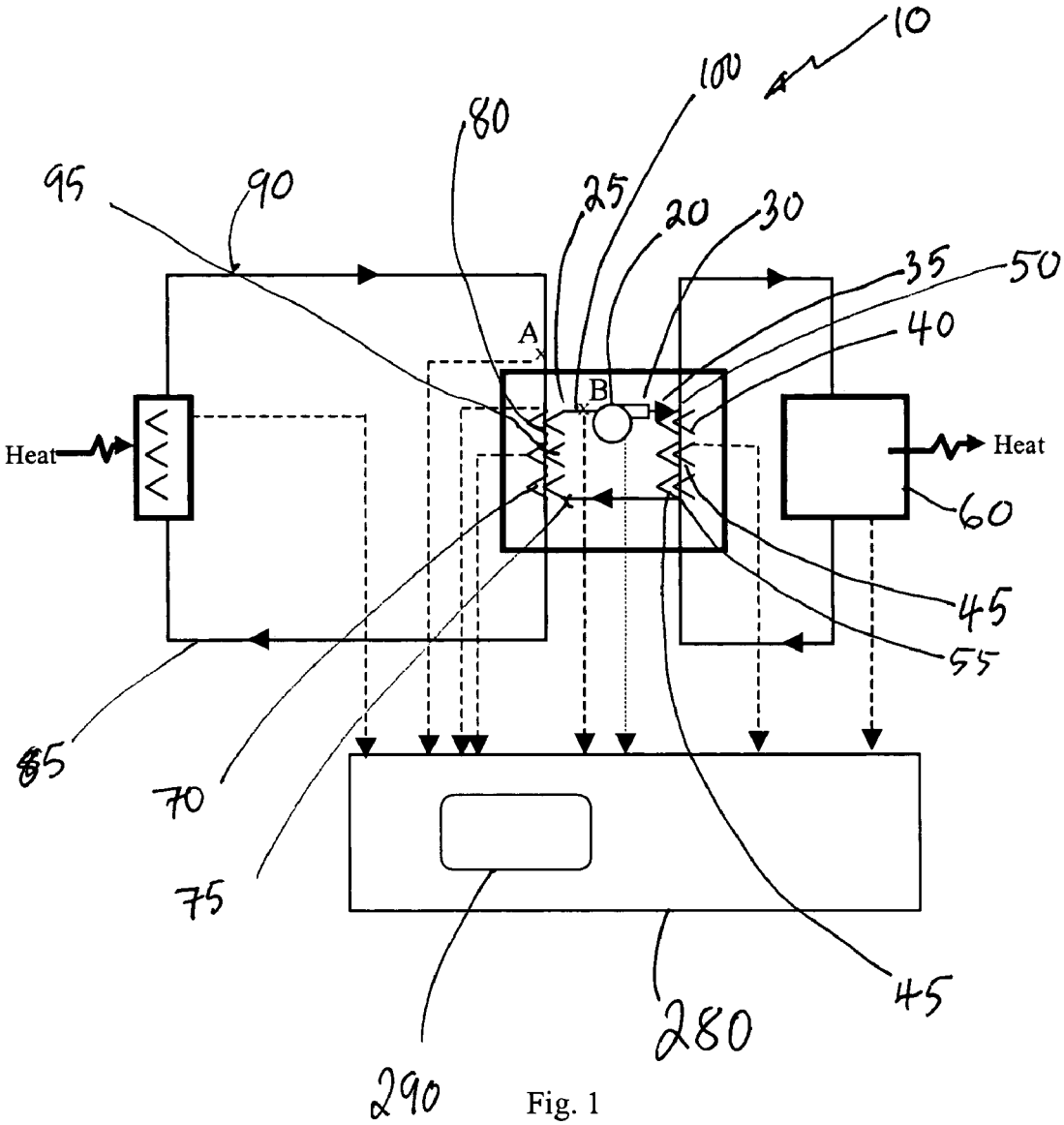
FIG. 1 is a schematic diagram of a surge detection system according to a first embodiment of this invention.

The present invention pertains to a method and apparatus for detecting surge in a compressor of a compressor-driven system. A compressor-driven refrigeration system is an example of such a system. FIG. 1 is a schematic diagram of a surge detection system according to a first embodiment of this invention. In FIG. 1, reference symbol 10 designates a basic refrigeration system. As shown in FIG. 1, the refrigeration system 10 comprises a centrifugal compressor 20, having a suction side 25 and a discharge side 30 and a compressor impeller (not shown). A discharge side conduit 35 connects discharge side 30 to a condenser 40. The compressor compresses the refrigerant and delivers the compressed gas to condenser 40. Condenser 40 includes a heat-exchange coil 45 having an inlet 50 and an outlet 55 connected to a cooling tower 60 or other cooling system that circulates a cooling fluid, such as water, through the heat exchange coil 45. The refrigerant flowing through condenser 40 exchanges heat with the cooling fluid circulating through heat-exchange coil 45 causing the compressed gas to condense to a liquid refrigerant.

Condensed liquid refrigerant from the condenser 40 flows to an evaporator 70. An orifice 75 within the line to evaporator 70 causes a pressure drop that regulates the flow of refrigerant to the evaporator. Evaporator 70 includes a second heat-exchange coil 80 having a supply line 85 and a return line 90 connected to a cooling coil 95 and having a cooling fluid such as water circulating through heat-exchange coil 80. As the liquid refrigerant flows through evaporator 70, the cooling fluid exchanges heat with the liquid refrigerant causing it to vaporize thereby chilling the cooling fluid. Gaseous refrigerant from the evaporator returns to the compressor via a suction line 100.

Reference symbol "A" in FIG. 1 exemplifies a location near the suction entrance 120 of evaporator 70 where a first temperature measurement 200 of the cooling fluid is taken. In an alternate embodiment, the first temperature measurement may be taken within return line 90. Reference symbol "B" in FIG. 2 exemplifies a location in suction side 25 that constitutes the entrance to the compressor impeller (not shown) where a second temperature measurement 210 of the refrigerant is taken. In another embodiment of the invention, second temperature measurement 210 may be measured within the compressor at a location proximate the impeller.

Figure 2:
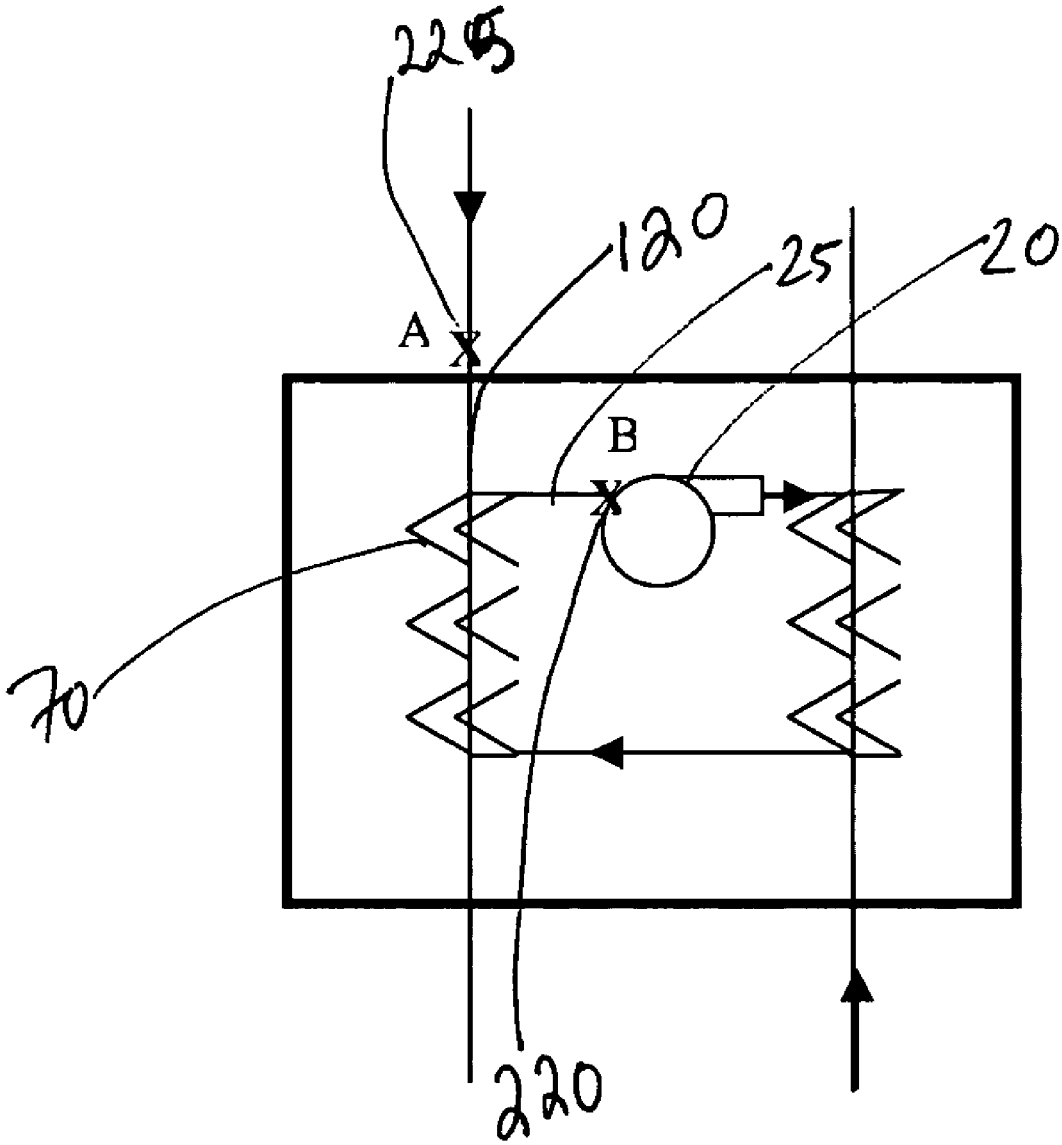
FIG. 2 is a more detailed schematic diagram of a surge detection system of FIG. 1.

FIG. 2 depicts the relative positions of reference marks "A" and "B" where temperature measurements are taken according to one exemplary embodiment of the invention. A typical refrigeration system includes many other features that are not shown in FIGS. 1 and 2. Those features not shown are not necessary to describe the present invention.

In operation, an exemplary embodiment of the present invention utilizes temperature sensors placed in proximity to reference marks "A" and "B," as shown in FIGS. 1 and 2. The temperature sensors may generate a signal whose value is indicative of the measured temperature. For example, the signal may be a voltage proportional to the measured temperature. A suction temperature sensor 220 measures a value indicative of the second temperature measurement 210 proximate the compressor, for example, at the entrance to the compressor impeller (reference mark "B"). An evaporator water temperature sensor 225 measures a value indicative of the first temperature value 200 proximate the evaporator, for example, at the entrance of the water line into the evaporator (reference mark "A"). Under normal operating conditions where surging is not present, the suction temperature 210 should not deviate from the evaporator water temperature 200. If the compressor undergoes a surge condition, it will add thermal energy in the form of heat to the refrigerant gas flowing into the compressor causing second temperature measurement 210 to rise. Another aspect of the invention includes means for monitoring the differential between the two sensors (located at "A" and "B," respectively) through any of the several means known in the art for monitoring and controlling the operation of refrigeration systems.

Yet another aspect of the present invention is to determine if the differential sensed by the suction temperature sensor 220 and the evaporator water temperature sensor 225 exceeds a set point parameter indicative of an operating condition of the compressor. In operation, the set point parameter will vary with the operating condition of centrifugal compressor 20. The first operating condition is when the compressor is in the "off" state or non-operational. This operating condition is referred to as an off-state condition. When the compressor is not operating, the means for comparing the temperature differential will automatically signal no surge fault.

The second operating condition is when the compressor is in a "starting" state. This state is unique since the suction temperature sensor 220 located in the compressor case may be warmed excessively by the gear case heaters and surrounding ambient temperatures. Prior to starting the compressor 20, the evaporator water temperature may be held low by other chillers in the refrigeration system 10. Therefore, if the suction temperature is greater than entering evaporator water temperature, the surge detection system will protect the system by detecting surge when there is an increase in temperature with time during startup. If the suction temperature is rising faster than the water temperature, the surge detection system will create a surge fault to shut down the compressor. When the suction temperature falls below some fraction of the set point that will cause a surge fault during normal running conditions, then the surge detection system switches to normal surge fault protection as described below.

The third operating condition encountered by the surge detection system is during normal running of the compressor. A surge fault is registered and the compressor is shut down if, while the compressor is running, the difference between the suction temperature and the evaporator water temperature exceeds a set point.

Figure 3:
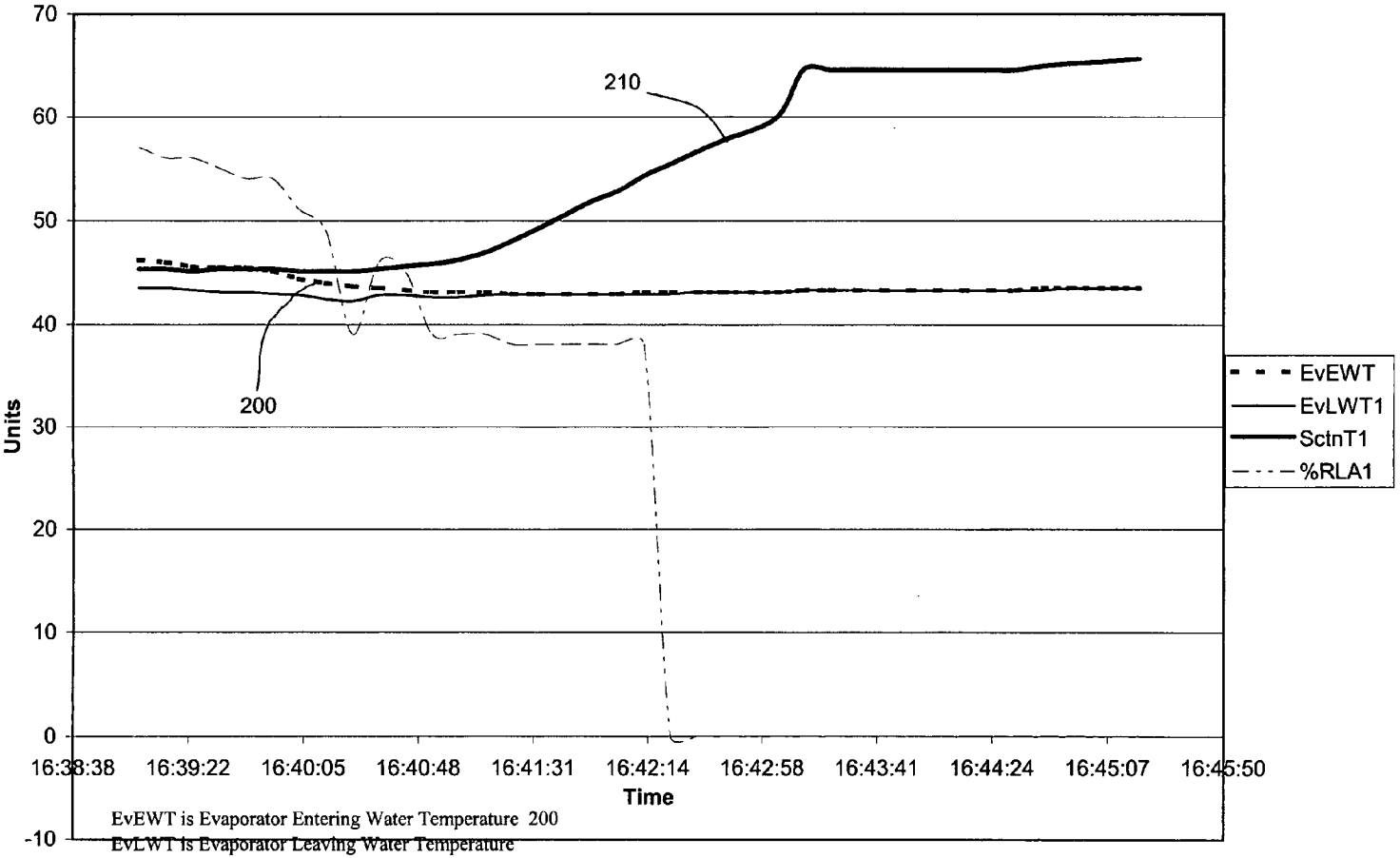
FIG. 3 is a chart showing an exemplary set of temperature measurements utilized in accordance with the present invention.

FIG. 3 is a chart showing an exemplary set of temperature measurements at reference points "A" and "B" in accordance with one embodiment of the present invention.

The refrigeration system of a preferred embodiment of the present invention further includes a chiller control panel 280 having a main microprocessor 290. It will be evident to one skilled in the art that analog circuitry, a digital processor, software, firmware or any combination thereof may be used in place of the microprocessor board 290. In an exemplary embodiment, microprocessor 290, receives signals representative of suction temperatures and evaporator water temperatures from suction temperature sensor 220 and evaporator water temperature sensor 225 respectively. It will be evident to one skilled in the art that instead of using two sensors to measure the temperatures at each of the two locations, the temperature differential between the temperatures at the two locations may instead be measured by using a suitable sensor. Furthermore, the temperature signals may be acquired continuously or periodically. Microprocessor 290 also implements routines that detect changes in the operational condition of the centrifugal compressor and computes a set point corresponding to the detected operational condition. In one embodiment, the deviation of the temperature differential from the set point is representative of a surge condition. Desirably, on detecting surge, the microprocessor 290 generates control signals to adjust the operation of the refrigerant system.

While the invention has been described with reference to a preferred embodiment as disclosed above, it is to be clearly understood by those skilled in the art that the invention is not limited thereto.

The invention claimed is:

1. A method for detecting surge in a refrigeration system, said refrigeration system including a centrifugal compressor having an impeller and a compressor entrance, an evaporator that receives a fluid refrigerant, a suction line that flows said refrigerant from said evaporator to said compressor entrance, said evaporator including a heat-exchange coil supplied with a liquid through a supply line entering said evaporator, said liquid disposed in a heat-exchange relationship with said refrigerant within said evaporator, the method comprising automatically and periodically performing the steps of:

measuring a fluid temperature of said liquid proximate said supply line entering said evaporator;

measuring a refrigerant temperature of said refrigerant proximate said compressor entrance;

using said fluid temperature and said refrigerant temperature to detect surge in said refrigeration system by computing a value indicative of a temperature difference between said fluid temperature and said refrigerant temperature; and comparing said value to a set point temperature.

2. The method of claim 1, wherein the step of using said fluid temperature and said refrigerant temperature to detect surge comprises:

generating a compressor-status parameter indicative of an operating condition of said centrifugal compressor;

deriving a set point parameter from said compressor-status parameter;

computing a value indicative of a temperature difference between said fluid temperature and said refrigerant temperature; and comparing said value to said set point parameter.

3. The method of claim 2, wherein said operating condition of said centrifugal compressor is selected from a set consisting of: off-state, starting and normal running.

4. A method for detecting surge in a centrifugal compressor having a compressor entrance in fluid communication with an evaporator, said evaporator adapted to receive a fluid refrigerant and disposed in a heat-exchange relationship with a liquid entering said evaporator at a suction entrance and flowing through a heat-exchange coil located in said evaporator, said method comprising automatically and periodically performing the steps of:

generating a compressor-status parameter which defines an operating condition for said centrifugal compressor;

calculating a set point parameter in accordance with said compressor-status parameter;

positioning a first temperature sensor proximate said compressor entrance to measure a refrigerant temperature;

positioning a second temperature sensor near said suction entrance to measure a liquid temperature; and using said liquid temperature, said refrigerant temperature and said set point temperature to detect surge.

5. A method for detecting surge in a centrifugal compressor having a compressor entrance fluidly connected to an evaporator, said evaporator flowing a refrigerant, said refrigerant received from a condenser and disposed in heat-exchange relationship with a liquid entering said evaporator at a suction entrance, said method comprising automatically and periodically performing the steps of:

determining a first thermodynamic parameter at a first location within said liquid proximate said evaporator entrance;

determining a second thermodynamic parameter at a second location within said refrigerant proximate said compressor; and detecting surge from said first and said second thermodynamic parameters by computing a value indicative of a parameter difference between said first thermodynamic parameter and said second thermodynamic parameters: and comparing said value to a set point parameter.

6. The method of claim 5, wherein the first thermodynamic parameter is temperature.

7. The method of claim 5, wherein the second thermodynamic parameter is temperature.

8. The method of claim 5, wherein the step of detecting surge further comprises:

periodically determining an operational condition of said centrifugal compressor; and obtaining a parameter indicative of surge from said first thermodynamic parameter, said second thermodynamic parameter and said operational condition.

9. The method of claim 8, wherein said operational condition of said compressor is selected from a set consisting of: off-state, starting and normal running.

10. An apparatus for detecting surge in a centrifugal compressor in fluid communication with an evaporator at a compressor entrance, said evaporator flowing a refrigerant fluid in heat-exchange relationship with a liquid entering said evaporator proximate a evaporator suction entrance, said apparatus comprising:

means for detecting a first temperature of said refrigerant proximate said compressor entrance;

means for detecting a second temperature of said liquid proximate said evaporator suction entrance;

means for determining a differential between said first temperature and said second temperatures; and means for detecting surge by comparing said differential to a set point parameter.

11. The apparatus of claim 10, wherein said means for detecting said first temperature is a temperature sensor.

12. The apparatus of claim 11, wherein said means for detecting said second temperature is a temperature sensor.

13. The apparatus of claim 10, wherein said means for determining said differential and said means for detecting surge are implemented as an operative arrangement selected from the set consisting of: analog circuitry, a digital processor, software, firmware or any combination thereof.

14. The apparatus of claim 13, wherein said means for determining said differential controls an operation condition of said centrifugal compressor responsive to said differential.

15. A method for detecting surge in a centrifugal compressor connected in series and in fluid communication with an evaporator at a compressor entrance, said evaporator flowing a refrigerant fluid in heat-exchange relationship with a liquid entering said evaporator proximate a evaporator suction entrance, said method comprising the step of:

periodically comparing a temperature differential between a first temperature measured in said refrigerant fluid proximate said compressor entrance and a second temperature measured in said liquid proximate said evaporator suction entrance to a set point temperature indicative of an operating condition of said centrifugal compressor.

16. The method of claim 15, wherein said operating condition of said centrifugal compressor is selected from a set consisting of: off-state, starting and normal running.

17. A method for detecting surge in a centrifugal compressor connected in series and in fluid communication with an evaporator at a compressor entrance, said evaporator flowing a refrigerant fluid in heat-exchange relationship with a liquid entering said evaporator proximate a evaporator suction entrance, said method comprising the step of:

periodically comparing a rate of change of a temperature differential between a first temperature measured in said refrigerant fluid proximate said compressor entrance and a second temperature measured in said liquid proximate said evaporator suction entrance to a set point temperature indicative of an operating condition of said centrifugal compressor.

18. The method of claim 17, wherein said operating condition of said centrifugal compressor is selected from a set consisting of: off-state, starting and normal running.

19. A method of detecting surge in a centrifugal compressor having an impeller and a compressor entrance in fluid communication with said impeller, said compressor entrance connected to a evaporator, said evaporator adapted to receive refrigerant from a condenser, said refrigerant disposed in heat-exchange relationship with a liquid entering said evaporator at a evaporator suction entrance and flowing within a heat-exchange coil disposed in said evaporator, the method comprising the steps of:

monitoring a first temperature of said refrigerant before said refrigerant enters said compressor entrance;

monitoring a second temperature of said liquid before said liquid enters said evaporator suction entrance; and detecting surge from calculations involving said first temperature, said second temperature and a set point temperature.

20. The method of claim 19, wherein the step of detecting surge from calculations comprises the steps of:

detecting surge responsive to a deviation of a temperature difference between said first temperature and said second temperature from a set point parameter indicative of an operating condition of said centrifugal compressor by a selected amount.

21. The method of claim 20, wherein said deviation of said temperature difference from said set point is measured by an operative arrangement selected from the set consisting of: analog circuitry, a digital processor, software, firmware or any combination thereof.

22. The method of claim 20, wherein said operating condition of said centrifugal compressor is selected from a set consisting of: off-state, starting and normal running.

23. A method for detecting surge in a refrigeration system, said refrigeration system including a centrifugal compressor means having an impeller and a compressor entrance, an evaporator means for receiving a fluid refrigerant, a suction line for flowing said refrigerant from said evaporator means to said compressor entrance, said evaporator means including a heat-exchange coil means supplied with a liquid through a supply line entering said evaporator means, said liquid disposed in a heat-exchange relationship with said refrigerant within said evaporator means, the method comprising automatically and periodically performing the steps of:

measuring a fluid temperature of said liquid proximate said supply line entering said evaporator means;

measuring a refrigerant temperature of said refrigerant proximate said compressor entrance;

using said fluid temperature and said refrigerant temperature to detect surge in said refrigeration system by periodically determining an operational condition of said centrifugal compressor means; and obtaining a parameter indicative of surge from said fluid temperature, said refrigerant temperature and said operational condition.

24. The method of claim 23, wherein said step of measuring said fluid temperature comprises the steps of:

positioning a first temperature sensor proximate said supply line entering said evaporator.

25. The method of claim 23, wherein said step of measuring said refrigerant temperature comprises the steps of:

positioning a second temperature sensor proximate said compressor entrance.

26. The method of claim 23, wherein said operational condition of said compressor is selected from a set consisting of: off-state, starting and normal running.

27. The method of claim 23, wherein the step measuring said refrigerant temperature includes the step of:

positioning a second temperature sensor in said suction line in the vicinity of said compressor entrance.

28. The method of claim 23, wherein the step measuring said refrigerant temperature includes the step of:

positioning a second temperature sensor proximate said impeller.

* * * * *

UNITED STATES PATENT AND TRADEMARK OFFICE

CERTIFICATE OF CORRECTION

PATENT NO. : 7,069,734 B2
APPLICATION NO. : 10/827109
DATED : July 4, 2006
INVENTOR(S) : Knopp It is certified that error appears in the above-identified patent and that said Letters Patent is hereby corrected as shown below:

Column 6, Line 25:

After "parameters" delete ":" and insert --;--.

Signed and Sealed this

Twenty-first Day of August, 2007

JON W. DUDAS
*Director of the United States Patent and Trademark Office*